US005369389A

United States Patent [19]

Schrammek et al.

[11] Patent Number: 5,369,389

[45] Date of Patent: Nov. 29, 1994

[54] TRANSFORMER COMPRISING A PLASTICS COIL FORMER

[75] Inventors: Manfred Schrammek, Wetzlar; Sieghard Post, Herborn; Klaus Schütz, Wetzlar; Heinrich Theissen, Wuppertal, all of Germany

[73] Assignee: U.S. Philips Corporation, New York, N.Y.

[21] Appl. No.: 991,453

[22] Filed: Dec. 16, 1992

Related U.S. Application Data

[63] Continuation of Ser. No. 900,868, Jun. 18, 1992, abandoned.

[30] Foreign Application Priority Data

Jun. 24, 1991 [DE] Germany ..... 4120771

[51] Int. Cl.[5] ..... H01F 27/30

[52] U.S. Cl. ..... 336/206; 336/208

[58] Field of Search ..... 310/194; 242/118.4; 336/192, 198, 206, 208

[56] References Cited

U.S. PATENT DOCUMENTS

| | | | |
|---|---|---|---|
| 4,048,606 | 9/1977 | Miller | 336/198 |
| 4,250,479 | 2/1981 | Bausch et al. | 336/208 |
| 4,546,340 | 10/1985 | Kuchuris | 336/192 |

*Primary Examiner*—Thomas J. Kozma
*Attorney, Agent, or Firm*—Edward Blocker

[57] ABSTRACT

A transformer having a plastics coil former on whose hollow winding tube (7) between flanges (3, 5) windings (11, 13) of different potentials are wound with one winding wound on top of the other. The flanges (3, 5) are provided with spacers (17, 19, 23) to keep the windings (11*a*, 13*a*) axially spaced from the flanges (3, 5). An insulating layer (21), which extends from flange to flange, is interposed between the windings (11, 13). The winding (11) nearer the coil-former axis is spaced from the flanges (3, 5) by fixed spacers or stepped portions (17, 19) provided on the winding tube (7). The winding (13) arranged on the insulating layer (21) is spaced from the flanges (3, 5) by spacing blocks (23) which are connected to the flange areas (24) of the coil former by integral hinges (25). The spacing blocks are operable for swinging down onto the insulating layer (21).

14 Claims, 2 Drawing Sheets

TRANSFORMER COMPRISING A PLASTICS COIL FORMER

This is a continuation of application Ser. No. 07/900,868, filed JUN. 18, 1992 now abandoned.

BACKGROUND OF THE INVENTION

The invention relates to a transformer having a plastics coil former with hollow winding tube. Wound between coil flanges of the plastics coil former are windings of different potentials. The flanges are provided with spacers to maintain the windings axially spaced from the flanges. An insulating layer, which extends from flange to flange, is interposed between the windings.

Particularly in the case of a conventional transformer in which a large potential difference between primary and secondary windings exists, transformer insulation requirements must be carefully observed. Suitable and well known techniques in complying with these requirements include the steps of insulating the windings from one another and proper dimensioning of air gaps and/or creepage paths (see for example EP-B-0,092,870).

The position of the transformer windings relative to each other are dictated by the required clearances between windings and must be maintained throughout the manufacturing process and service life of the transformer. In positioning the transformer windings within a conventional transformer, insulating parts, such as, for example, corrugated spacer rings, are disposed in the clearances between the windings. Production and mounting of these insulating parts in smaller transformers can be relatively expensive, significantly increasing the manufacturing cost.

SUMMARY OF THE INVENTION

It is therefore an object of the invention to provide a transformer in which spacers for properly positioning the transformer windings are part of rather than separate from the coil former so as to minimize manufacturing cost.

According to the invention this object is achieved by requiring a first winding nearer the coil-former axis be spaced from the coil former flanges through fixed spacers or stepped portions provided on the coil former winding tube. A second winding positioned on top of an insulating layer is spaced from the flanges by rotatable spacing blocks which are connected to the flange areas of the coil former by integral hinges. Prior to positioning the second winding on the insulating layer, the rotatable spacing blocks are swung down onto the insulating layer so as to define a winding area situated between the insulating layer and spacing blocks in which the second winding is wound.

The stepped portions provided at the location of the first (lower) winding, which are in fact portions of enlarged diameter of the winding tube of the coil former, do not interfere with winding of the lower winding which, for example, can serve as the primary winding around the coil former. During winding of the lower winding and positioning of the insulating layer, the spacing blocks are pivoted out of (away from) the winding area. After positioning of the insulating layer, the spacing blocks are pivoted toward and into the winding area. The upper winding, which can serve as the secondary of the transformer, can now be securely positioned in this winding area (i.e. on top of the lower winding with the insulating layer interposed between the lower and upper windings). The spacing blocks can be swung onto the insulating layer by hand or in an automated fashion.

In a further embodiment of the invention, the spacing blocks on one flange are 90° offset relative to those on the other flange. This facilitates mould construction.

In a further embodiment of the invention, the spacing blocks have flexible tongues which point towards the respective opposite flange with the spacing blocks swung down and into the winding area. The tongues are enveloped by the upper winding at the beginning of the upper winding process and thereby maintain the spacing blocks in their final positions as winding of the upper winding proceeds. The tongues adapt themselves to the winding profile and thereby prevent the upper winding from sliding toward a flange between the spacing blocks and insulating layer. Reduction in creepage path length and resulting safety problems are thereby avoided.

In a further embodiment of the invention the tongues comprise a plurality of parallel arms. As a result of the division into parallel arms, the tongues are more flexible in a circumferential direction and can better adapt themselves to the curvature of the winding profile.

In a further embodiment of the invention during winding of the lower winding the spacing blocks include breakable arms which immobilize the spacing blocks in a swung-up position. Preferably, the limbs have preformed thinner portions which are susceptible to breakage when the spacing blocks are swung downwardly toward the insulating layer. This ensures that the spacing blocks cannot inadvertently enter the winding space while the lower winding is being wound.

BRIEF DESCRIPTION OF THE DRAWINGS

The invention will now be described in more detail with reference to the drawings. In the drawings.

DETAILED DESCRIPTION OF THE PREFERRED EMBODIMENTS

Figure 1:
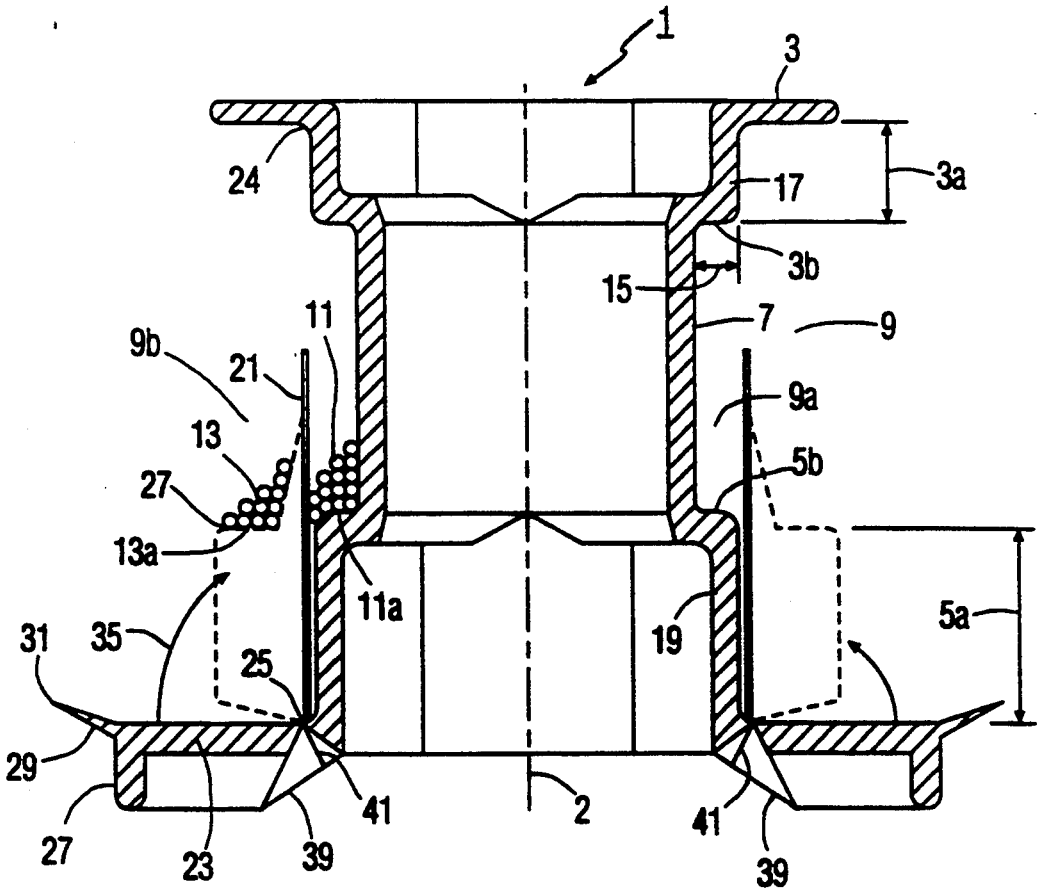
FIG. 1 is a sectional view of a coil former of a transformer, which coil former has fixed stepped portions for a lower winding and rotatable spacing blocks for an upper winding.

The coil former 1, shown in FIG. 1, has an axis 2 and comprises flanges 3 and 5 (for the sake of clarity flange 5 is not shown in FIG. 1 interconnected by a hollow winding tube 7. A winding space 9 defined between flanges 3 and 5 is provided with a lower winding 11 and an upper winding 13. Near flanges 3 and 5, winding tube 7 has a pair of portions **3*a* and 5*a* of enlarged diameter, resulting in shoulders 3*b* and 5*b* forming stepped portions which define axial boundaries 11*a* of the lower winding 11. The height of winding 11 corresponds to a depth 15 of shoulders 3*b* and 5*b*. Lower winding 11 arranged between a pair of stepped portions 17 and 19 fills winding space 9*a***.

A multiple insulating layer 21 is wrapped around lower winding 11 and, in contrast with lower winding 11 extends from flange 3 to flange 5. Thus, insulating layer 21 extends beyond lower winding 11.

Figure 2:
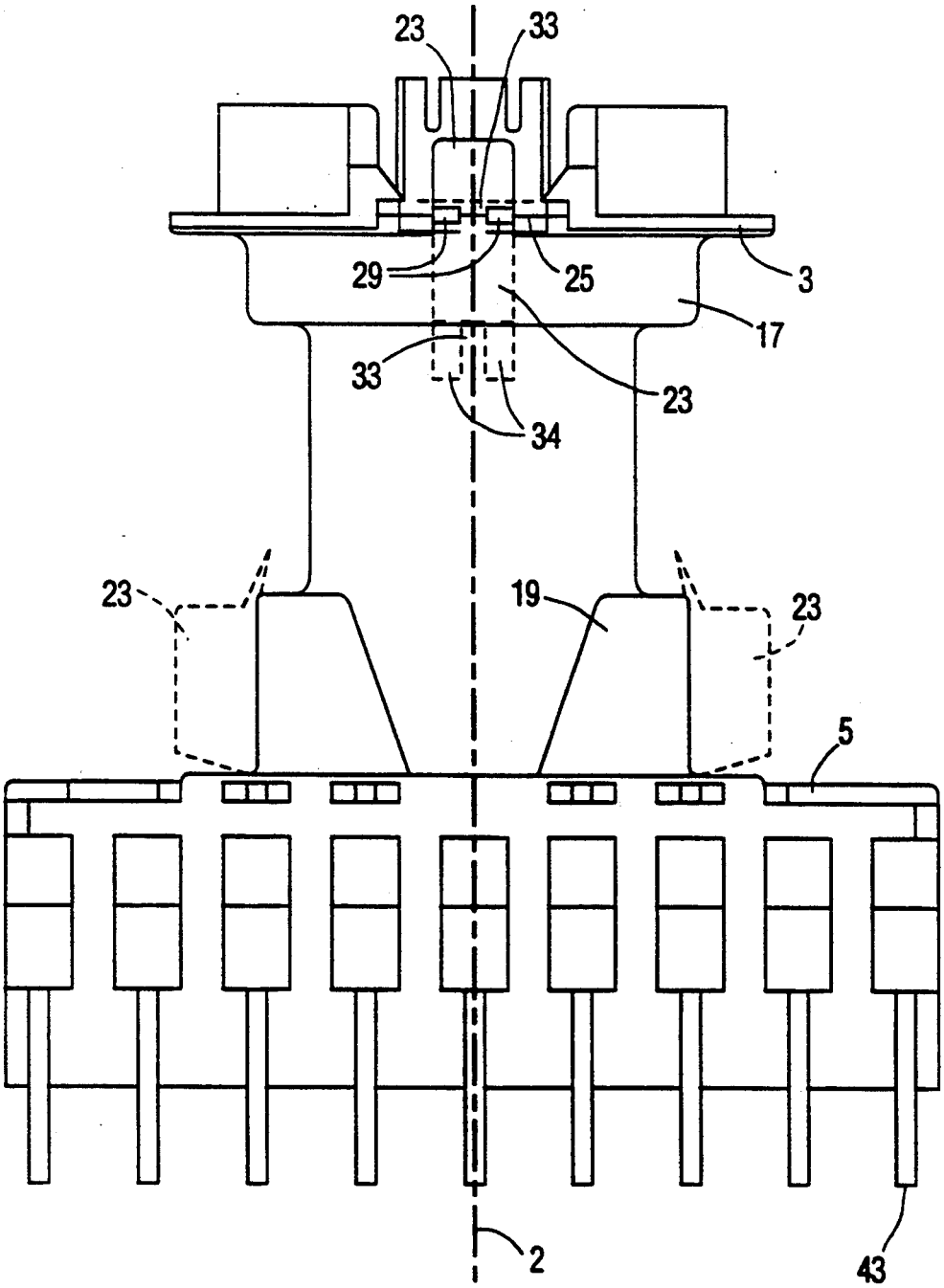
FIG. 2 is a plan view of the coil former.

At a plurality of flange areas 24 of plastics coil former 1 and molded thereto are a plurality of spacing blocks 23 which are connected to coil former 1 by a plurality of associated integral hinges 25. A free front surface 27 of each spacing block 23 includes a molded-on tongue 29 which tapers towards a corresponding distal end 31. Tongues 29 are divided into parallel arms 34 through a plurality of slits 33 (FIG. 2). Spacing blocks 23 are positioned outside winding space 9 during both the winding of lower winding 11 and disposal of insulating layer 21.

After lower winding 11 and insulating layer 21 are properly positioned within winding space 9, spacing blocks 23 are swung onto insulating layer 21 in the directions indicated by a pair of arrows 35 creating a winding space **9*b*. Space 9*b* is situated between insulating layer 21 and front surfaces 27 of spacing blocks 23. The swung-down positions of spacing blocks 23 are shown in broken lines in FIGS. 1 and 2. Tongues 29 are disposed underneath the lowermost layer of upper winding 13. This lowermost layer maintains spacing blocks 23 in their swung-down positions. Front surfaces 27 define the axial dimension 13*a* of upper winding 13. Spacing blocks 23 in their swung-down positions serve as shoulders for upper winding 13** to rest against.

As can now be readily appreciated, clearances between the primary winding (e.g. winding 11) and the secondary winding (e.g. winding 13) in the finished transformer are well defined. Spacing blocks 23 need not be manufactured and handled as separate parts but are arranged on coil former 1. Blocks 23 are swung down only after lower winding 11 and insulating layer 21 have been properly positioned in winding space 9. This can be effected, if desired, by means of an automated process.

FIG. 2 shows spacing blocks 23 on flange 3 and on flange 5 offset by 90° relative to each other. Wedge-shaped portions 37 at opposite sides of the spacers 23 permit spacing blocks 23 to be latched in their swung-down positions.

To prevent rotation of spacing blocks 23 during winding of winding 11 and disposal of insulation layer 21 and to otherwise inhibit any uncontrolled movement by integral hinges 25, each spacing block 23 is initially connected to its respective flange by an associated thin limb 39. When spacing blocks 23 are swung into winding space 9, limbs 39 are severed, for example, by breaking. It is possible to facilitate breaking by a preformed thinner portion 41 of material.

The other elements of coil former 1 are of conventional construction. FIG. 2 shows, for example, connector pins 43 to provide connection with the power supply of the transformer.

It will thus be seen that the object set forth and those made apparent from the preceding description are efficiently attained and since certain changes may be made in the above continuation without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which as a matter of language might be said to fall therebetween.

We claim:

1. A transformer comprising a plastics coil former having a pair of flanges, a hollow winding tube, and a first winding and a second winding wound around said tube between said flanges, said second winding being wound on top of said first winding, at least one first spacing means for axially spacing said first winding away from said flanges (3, 5), insulating means for insulating said windings from each other and interposed between said windings and at least one second spacing means associated with each flange and rotatably coupled to said coil former for axially spacing said second winding away from said associated flange.

2. The transformer as claimed in claim 1, wherein each second spacing means associated with one flange is positioned 90° offset relative to the position of each second spacing means associated with the other flange.

3. The transformer as claimed in claim 1, wherein each second spacing means has a tongue and wherein the tongue of each second spacing means associated with one flange is operable for pointing towards the other flange.

4. The transformer as claimed in claim 3, wherein the tongues comprise a plurality of parallel arms.

5. The transformer as claimed in claim 1, wherein each second spacing means includes at least one breakable limb for immobilizing said second spacing means in a predetermined position away from said first spacing means whereby said first winding can be wound around said tube.

6. The transformer as claimed in claim 5, wherein each limb has a preformed thinner portion susceptible to breakage as said second spacing means associated with said limb is rotated towards said insulating means.

7. The transformer as claimed in claim 2, wherein each second spacing means has a flexible tongue and wherein the tongue of each second spacing means associated with one flange can be pivoted so as to point towards the other flange.

8. The transformer as claimed in claim 2, wherein each second spacing means includes at least one breakable limb for immobilizing said second spacing means in a predetermined position away from said first spacing means whereby said first winding can be wound around said tube.

9. The transformer as claimed in claim 3, wherein each second spacing means includes at least one breakable limb for immobilizing said second spacing means in a predetermined position away from said first spacing means whereby said first winding can be wound around said tube.

10. The transformer as claimed in claim 4, wherein each second spacing means includes at least one breakable limb for immobilizing said second spacing means in a predetermined position away from said first spacing means whereby said first winding can be wound around said tube.

11. The transformer as claimed in claim 8, wherein each limb has a preformed thinner portion susceptible to breakage as said second spacing means associated with said limb is rotated towards said insulating means.

12. The transformer as claimed in claim 9, wherein each limb has a preformed thinner portion susceptible to breakage as said second spacing means associated with said limb is rotated towards said insulating means.

13. The transformer as claimed in claim 10, wherein each limb has a preformed thinner portion susceptible to breakage as said second spacing means associated with said limb is rotated towards said insulating means.

14. The transformer as claimed in claim 1, further including hinge means for rotatably coupling each second spacing means to said coil former.

* * * * *